US010184656B2

(12) United States Patent
Yamashita

(10) Patent No.: US 10,184,656 B2
(45) Date of Patent: Jan. 22, 2019

(54) GRAND PIANO

(71) Applicant: KAWAI MUSICAL INSTRUMENTS MANUFACTURING CO., LTD., Hamamatsu-shi, Shizuoka-ken (JP)

(72) Inventor: Mitsuo Yamashita, Hamamatsu (JP)

(73) Assignee: KAWAI MUSICAL INSTRUMENTS MANUFACTURING CO., LTD., Hamamatsu-Shi (JP)

( * ) Notice: Subject to any disclaimer, the term of this patent is extended or adjusted under 35 U.S.C. 154(b) by 0 days.

(21) Appl. No.: 15/718,563

(22) Filed: Sep. 28, 2017

(65) Prior Publication Data

US 2018/0087768 A1 Mar. 29, 2018

(30) Foreign Application Priority Data

Sep. 29, 2016 (JP) ..... 2016-191369

(51) Int. Cl.

| | |
|---|---|
| ***F21V 33/00*** | (2006.01) |
| ***F21V 7/00*** | (2006.01) |
| ***G10C 1/04*** | (2006.01) |
| ***G10C 3/04*** | (2006.01) |
| *F21S 4/24* | (2016.01) |
| *F21Y 103/10* | (2016.01) |
| *F21Y 115/10* | (2016.01) |
| *G10C 3/06* | (2006.01) |

(52) U.S. Cl.

CPC ..... *F21V 33/0056* (2013.01); *F21V 7/005* (2013.01); *G10C 1/04* (2013.01); *G10C 3/04* (2013.01); *F21S 4/24* (2016.01); *F21Y 2103/10* (2016.08); *F21Y 2115/10* (2016.08); *G10C 3/06* (2013.01)

(58) Field of Classification Search

CPC ..... F21V 7/005; G10C 3/04

See application file for complete search history.

(56) References Cited

U.S. PATENT DOCUMENTS

| | | | | | |
|---|---|---|---|---|---|
| 3,346,732 | A * | 10/1967 | Crusius | F21V 33/00 | 362/86 |
| 3,943,815 | A * | 3/1976 | Gilbert | G10D 1/08 | 84/293 |
| 4,236,191 | A * | 11/1980 | Martinez | G02B 6/0005 | 362/554 |
| 4,563,933 | A * | 1/1986 | Kim | G10D 3/00 | 84/267 |
| 4,704,941 | A * | 11/1987 | Reilly | G10D 1/085 | 313/483 |
| 4,890,529 | A * | 1/1990 | Grant | G10D 3/00 | 362/263 |
| 5,796,025 | A * | 8/1998 | Haake | G10H 3/18 | 84/464 A |

(Continued)

OTHER PUBLICATIONS

"Grand Piano", Jun. 2016, Kawai Musical Instruments Mfg. Co., Ltd.

*Primary Examiner* — Robert W Horn

(74) *Attorney, Agent, or Firm* — Grossman, Tucker, Perreault & Pfleger, PLLC

(57) ABSTRACT

Provided is a grand piano comprising a rim made of a transparent material, an outer layer formed of a semi-light transmitting material, an inner layer and a bottom layer, which are formed of a material reflecting light received through the rim, and a light source comprising a plurality of point light sources to emit light toward the rim.

7 Claims, 5 Drawing Sheets

(56) References Cited

U.S. PATENT DOCUMENTS

| | | | | |
|---|---|---|---|---|
| 5,922,981 | A * | 7/1999 | Ballister | A63J 17/00 84/464 A |
| 6,225,544 | B1 * | 5/2001 | Sciortino | A63J 17/00 84/464 A |
| 9,082,313 | B1 * | 7/2015 | McCarthy | G09B 15/023 |
| 9,564,109 | B2 * | 2/2017 | Boxberger, Jr. | G10D 1/085 |
| 10,013,962 | B2 * | 7/2018 | Washington | H05B 33/0842 |
| 2007/0051226 | A1 * | 3/2007 | Diaz | G09B 15/02 84/477 R |
| 2018/0087768 | A1 * | 3/2018 | Yamashita | G10C 3/04 |

* cited by examiner

GRAND PIANO

CROSS-REFERENCE TO RELATED APPLICATIONS

This application claims the benefit of Japanese Patent Application No. 2016-191369 filed on Sep. 29, 2016 with the Japan Patent Office, the disclosure of which is incorporated herein by reference.

BACKGROUND

The present disclosure relates to a grand piano.

For example, a grand piano in which visible members including a rim, a lid, legs, and so on, are made of a transparent material such as acrylic or the like, is introduced on page 21 (CR-40A) of a brochure "*GRAND PIANO*", June 2016, Kawai Musical Instruments Mfg. Co., Ltd. Such a grand piano has a visually beautiful structure in which, for example, objects inside of the rim are visible through the rim above a frame if viewed from a position facing the rim.

SUMMARY

The present disclosure provides a grand piano in which visible members including a rim, a lid, legs, and so on, are made of a transparent material such as acrylic or the like, wherein the beauty of its visual appearance is improved.

The grand piano according to the present disclosure comprises: a rim made of a transparent material, the rim surrounding a soundboard; an outer layer layered in a belt shape on a lower side of an outer surface of the rim in a longitudinal direction of the rim, the outer layer being formed of a semi-light transmitting material, which reflects part of light received through the rim and allows a rest of the light received through the rim, other than the part reflected, to pass through; an inner layer layered on an area facing the outer layer across the rim on an inner surface of the rim, the inner layer being formed of a material reflecting light received through the rim; a bottom layer layered on a bottom surface of the rim, the bottom layer being formed of a material reflecting light received through the rim; and a light source comprising a plurality of point light sources arranged in series in a longitudinal direction of the outer layer at a position facing a lowest section of the outer layer across the rim on an area facing the inner surface of the rim, the plurality of point light sources emitting light toward the rim.

In the grand piano of the present disclosure, when the point light sources are turned on, the light emitted from each point light source is reflected repeatedly between the outer layer and the inner layer. As a result, a pattern of light points lined up in a direction from a lower side to an upper side emerges on the outer layer.

Further, in the grand piano of the present disclosure, when the point light sources are turned on, the light emitted from each point light source is reflected by the bottom layer; passes through the rim; and reaches the lid if it is present above the rim. As a result, a pattern created by the point light sources emerges on a top surface of the rim and on the lid.

Accordingly, in the grand piano of the present disclosure, when the point light sources are turned on, the patterns emerge not only on the area where the outer layer is layered on the rim, but also on the top surface of the rim and on the lid, whereby the beauty of the visual appearance can be enhanced as compared with a case of a grand piano in which a rim is merely made of a transparent material.

In the grand piano of the present disclosure, the outer layer may be layered on an area tall enough to cover and hide a fixture of a frame arranged above the soundboard if viewed from an outside of the rim. When a transparent rim is used, a fixture of a frame is visible in some cases. According to the present disclosure, however, the fixture of the frame can be hidden, so that the beauty of the visual appearance can be enhanced.

In the grand piano of the present disclosure, the inner layer may be layered on an area to contact the soundboard and thereunder. In this case, the inner layer may be provided on the inner surface of the rim by arranging an element equivalent to the inner layer on the soundboard and on an inner rim thereunder and bringing the soundboard and the inner rim in contact with the rim at the time of assembly.

In the grand piano of the present disclosure, the light source may be arranged at a position facing a lowest section of the inner surface of the rim. In such manner, the position where the light source is arranged is definite, which can inhibit an assembly operator from arranging the light source to a wrong position.

The light source of the grand piano of the present disclosure may be arranged in a mounting section, which is a hollow created in an inner rim arranged inside the rim. The mounting section may be created through processes such as planing of the inner rim. In such manner, the light source can be incorporated in the grand piano with less interference with other members, such as the inner rim, composing the grand piano.

The light source of the grand piano of the present disclosure may be formed by applying a tape-shaped light source along the rim. The tape-shaped light source comprises a tape-shaped main body and the plurality of point light sources arranged in series in a longitudinal direction of the main body on one surface of the main body. In such manner, the point light sources can be easily arranged merely by applying the tape-shaped light source along the rim.

LEDs may be used as the point light sources of the grand piano of the present disclosure.

BRIEF DESCRIPTION OF THE DRAWINGS

Hereinafter, an example embodiment of the present disclosure will be described with reference to the accompanying drawings, in which.

DETAILED DESCRIPTION

Figure 1A:
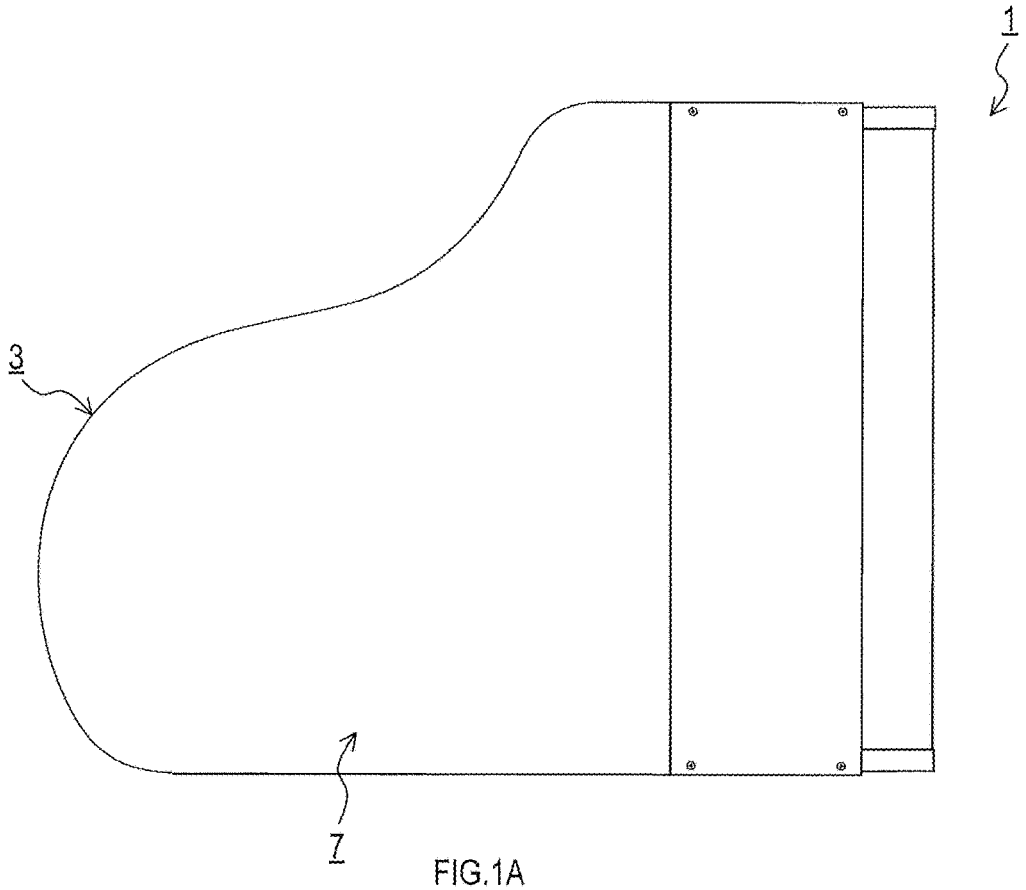
FIG. 1A is a plan view of a grand piano according to one embodiment.
Figure 1B:
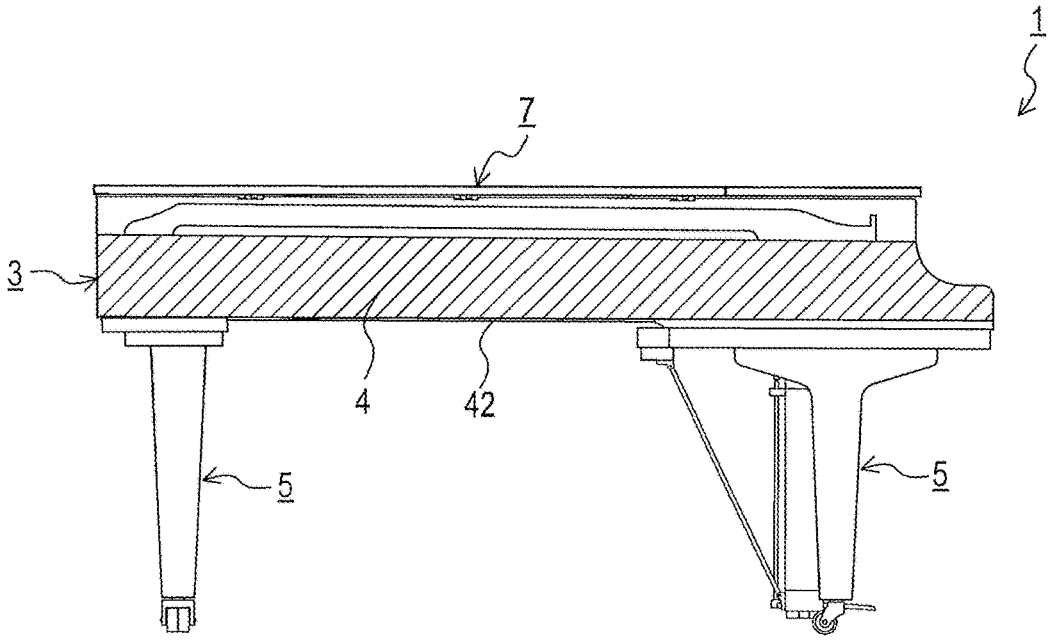
FIG. 1B is a left side view of the grand piano according to one embodiment.
Figure 2A:
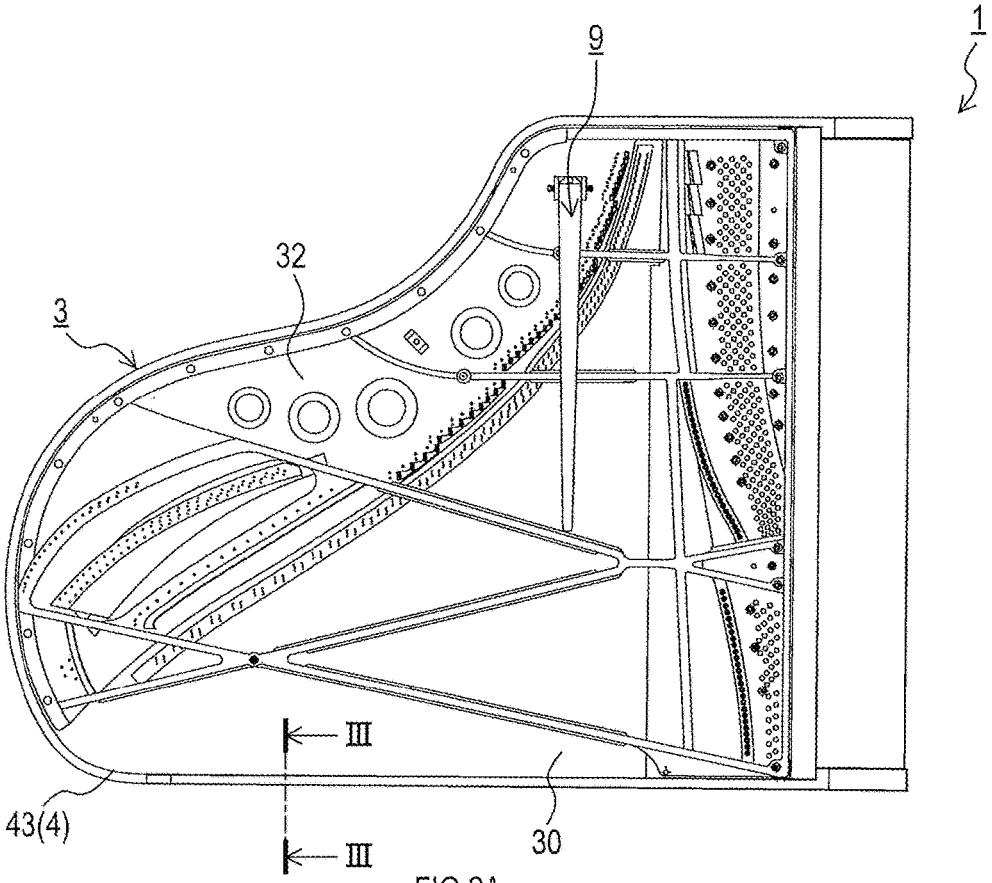
FIG. 2A is a plan view of the grand piano according to one embodiment, in which a lid and a music rack are omitted, and in which strings and an action are removed so as to show a soundboard and a frame.
Figure 2B:
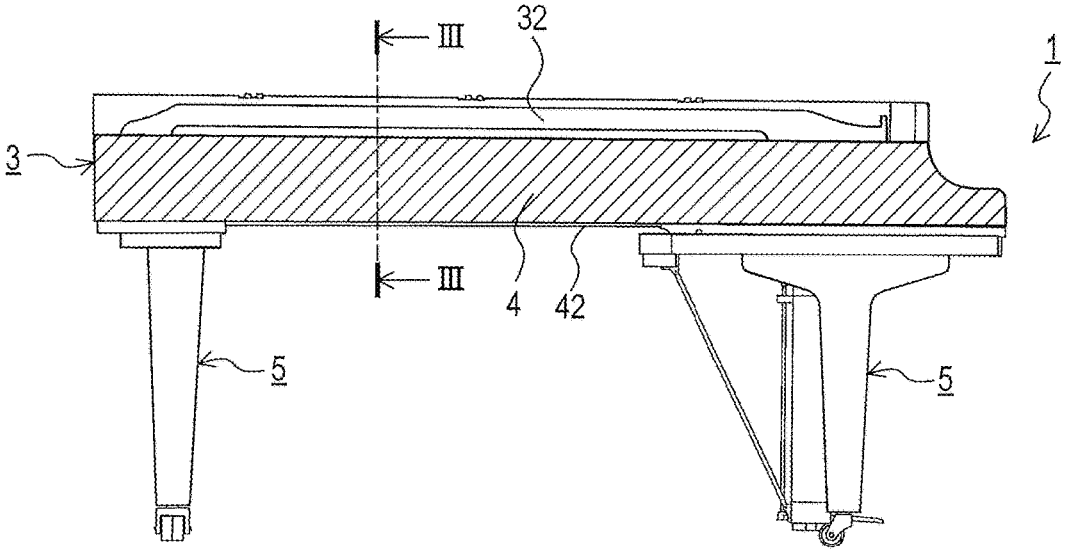
FIG. 2B is a left side view of FIG. 2A.

As shown in FIGS. 1A to 2B, a grand piano 1 of the present embodiment comprises a piano body 3, three legs 5, a lid 7, and a lid prop 9.

The piano body 3 comprises a rim 4 forming an outer peripheral wall surface. The rim 4 surrounds a soundboard 30. A frame 32 and so on are set above the soundboard 30. The soundboard 30 is set in a substantially central position in a depth direction of the piano body 3 in a space surrounded by the rim 4.

The three legs 5 are for arranging the piano body 3 at a specific height from a floor.

The lid 7 is mounted to the rim 4 with a hinge so as to open and close an opening arranged on an upper side of the space surrounded by the rim 4.

The rim 4, the legs 5, the lid 7, the lid prop 9, and so on, which compose the grand piano 1 of the present embodiment, are made of a transparent material (for example, acrylic).

Figure 3:
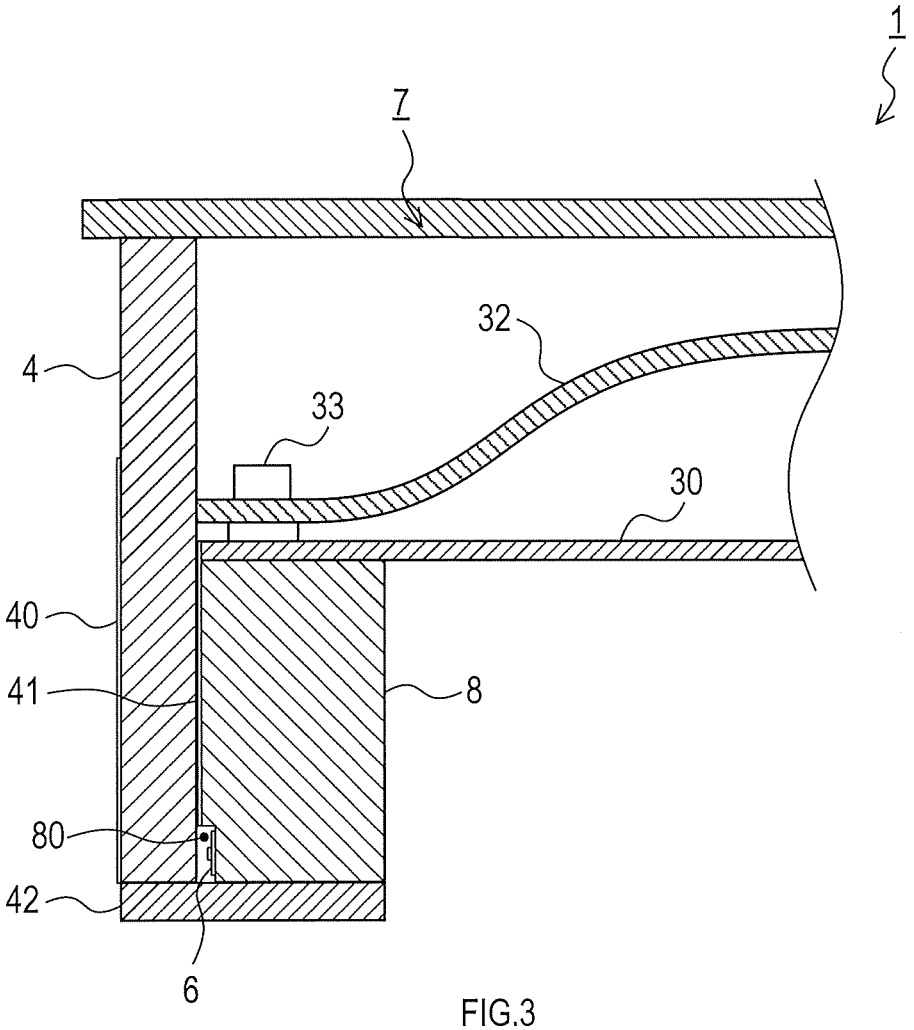
FIG. 3 is a schematic cross-sectional view taken along the line III-III in FIGS. 2A and 2B.

Next, the structure of a periphery of the rim 4 will be described using FIG. 3.

An outer layer 40 is layered on an outer surface of the rim 4 of the grand piano 1 of the present embodiment. The outer layer 40 is layered over an area ranging from the lower end of the rim 4 to a position high enough to cover and hide a fixture 33 of the frame 32, if the rim 4 is viewed from the outside. In other words, a top edge of the outer layer 40 is equal to or higher than a top surface of the fixture 33.

The outer layer 40 is formed of a sheet-type semi-light transmitting material, which is layered in a belt shape along the rim 4 in a longitudinal direction thereof. The outer layer 40 reflects part of light received through the rim 4 and allows the rest of the light received through the rim 4, other than the part reflected, to pass through.

An inner layer 41 is layered on an inner surface of the rim 4 of the grand piano 1 of the present embodiment. The inner layer 41 is formed of a mirror surface sheet. The grand piano 1 of the present embodiment is assembled with the soundboard 30 and an inner rim 8 to be described below being in contact with the inner surface of the rim 4. The inner layer 41 is layered on an area where the soundboard 30 and the inner rim 8 are in contact with the rim 4. The inner layer 41 reflects the light received through the rim 4.

In the grand piano 1 of the present embodiment, the inner rim 8 is provided adjacent to an area where the inner layer 41 is layered on the inner surface of the rim 4. The inner rim 8 is a long-shaped member provided along the rim 4 in the longitudinal direction thereof.

In the grand piano 1 of the present embodiment, provided on bottom surfaces of the rim 4 and the inner rim 8 is a bottom layer 42 forming a long-shaped stainless flat plate.

The inner rim 8 has a mounting section 80 provided for mounting of a tape-shaped light source 6 to be described below. This mounting section 80 is a hollow provided at a position facing the lowest section of the inner surface of the rim 4. The above-mentioned inner layer 41 is not provided to a position facing the mounting section 80.

Figure 4:
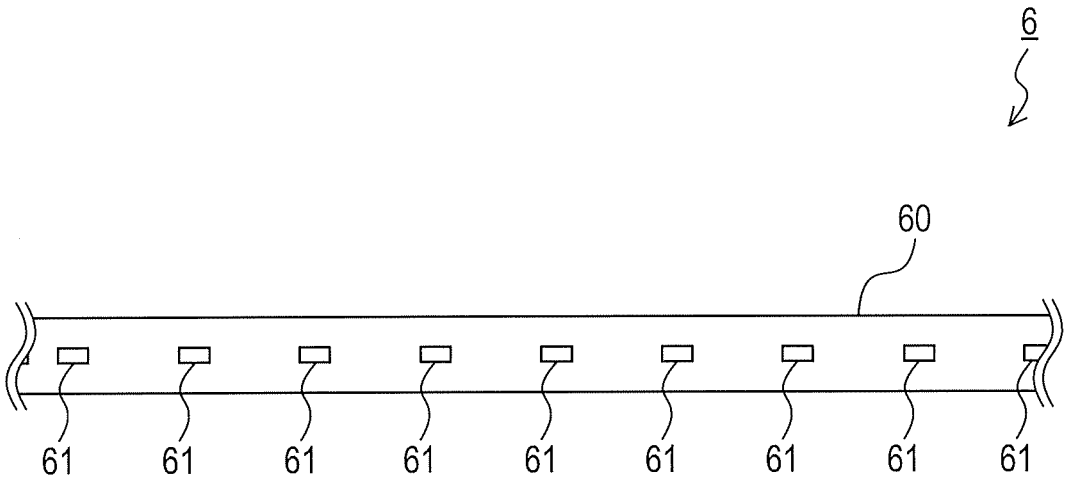
FIG. 4 is a plan view of an LED tape composing the grand piano according to one embodiment.

As shown in FIG. 4, the tape-shaped light source 6 comprises a main body 60 forming a tape shape, and a plurality of LEDs 61, which are point light sources arranged in series on one surface of the main body 60 in a longitudinal direction of the main body 60. The tape-shaped light source 6 is arranged in the mounting section 80 of the inner rim 8 so that emitted light hits the rim 4. Such arrangement of the tape-shaped light source 6 allows the plurality of LEDs 61 to be lined up along the rim 4 at a position facing the lowest section of the inner surface of the rim 4.

Figure 5:
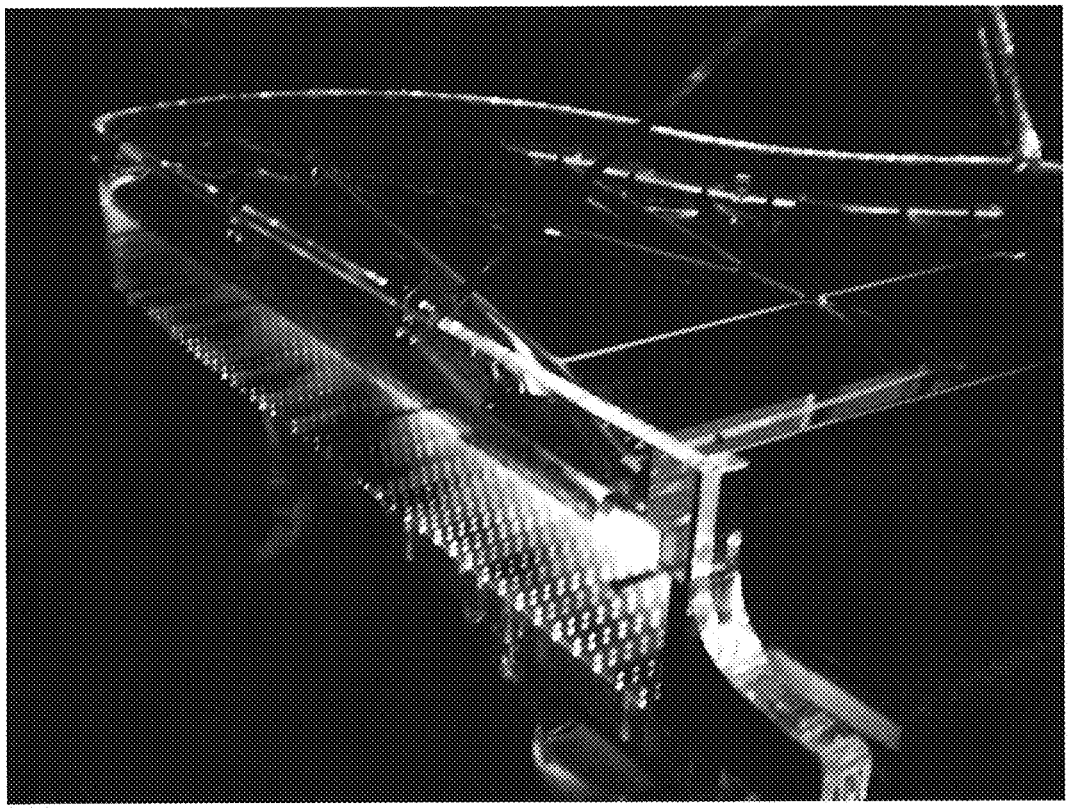
FIG. 5 is a photograph showing an appearance of the grand piano according to one embodiment when LEDs provided to the grand piano are emitting light.

In the grand piano 1 of the present embodiment, when the LEDs 61 are turned on, light emitted from each LED 61 is reflected repeatedly between the outer layer 40 and the inner layer 41. As a result, a pattern of the light points lined up in a direction from a lower side to an upper side emerges on the outer layer 40 as shown in FIG. 5.

Further, in the grand piano 1 of the present embodiment, when the LEDs 61 are turned on, the light emitted from each LED 61 is reflected by the bottom layer 42; passes through the rim 4; and reaches the lid 7 if it is present above the rim 4. As a result, a pattern created by the LEDs 61 emerges on a top surface 43 (see FIG. 2A) of the rim 4 and on the lid 7.

Accordingly, in the grand piano 1 of the present embodiment, when the LEDs 61 are turned on, the patterns emerge not only on the area where the outer layer 40 is layered on the rim 4, but also on the top surface 43 (see FIG. 2A) of the rim 4 and on the lid 7, whereby the beauty of the visual appearance can be enhanced as compared with a case of a grand piano in which a rim is merely made of a transparent material.

Moreover, the LEDs 61 of the present embodiment are arranged in the mounting section 80 which is the hollow created in the inner rim 8 placed inside the rim 4. As a result, the LEDs 61 can be incorporated in the grand piano 1 with less interference with other members, such as the inner rim 8, composing the grand piano 1.

Other Embodiments

One embodiment has been described so far. However, the grand piano of the present disclosure should not be limited by the aforementioned embodiment, and can take various forms.

(1) Although the tape-shaped light source 6 is used to mount the LEDs 61 in the aforementioned embodiment, the LEDs 61 may be mounted one by one in series in the mounting section 80 of the inner rim 8.

(2) In the aforementioned embodiment, the outer layer 40 may be layered in any manner as long as the outer layer 40 is layered in the belt shape on a lower side of the outer surface of the rim 4 in the longitudinal direction of the rim 4. Such an embodiment is merely one example.

(3) Although the outer layer 40 is formed of the sheet-type semi-light transmitting material in the aforementioned embodiment, the outer layer 40 may be formed by painting, plating or other process.

(4) In the aforementioned embodiment, the inner layer 41 may be layered in any manner as long as the inner layer 41 is layered on the area facing the outer layer 40 on the inner surface of the rim 4. Such an embodiment is merely one example.

(5) Although the inner layer 41 is formed of the mirror surface sheet, the inner layer 41 may be formed by painting, plating or other process.

(6) Although the bottom layer 42 is formed of the stainless in the aforementioned embodiment, other materials may be used, or the bottom layer 42 may be formed by painting, plating or other process.

(7) Elements of the present disclosure are conceptual, and should not be limited to the aforementioned embodiment. For example, a function/functions performed by one element may be performed by a plurality of elements, or functions performed by a plurality of elements may be integrally performed by one element. Moreover, at least part of the structure of the aforementioned embodiment may be replaced with a known structure having a similar function. In addition, at least part of the structure of the aforementioned embodiment may be added to or substituted with a structure of other embodiments described above.

What is claimed is:

1. A grand piano comprising:

a rim made of a transparent material, the rim surrounding a soundboard;

an outer layer layered in a belt shape on a lower side of an outer surface of the rim in a longitudinal direction of the rim, the outer layer being formed of a semi-light transmitting material, which reflects part of light received through the rim and allows a rest of the light received through the rim, other than the part reflected, to pass through;

an inner layer layered on an area facing the outer layer across the rim on an inner surface of the rim, the inner layer being formed of a material reflecting light received through the rim;

a bottom layer layered on a bottom surface of the rim, the bottom layer being formed of a material reflecting light received through the rim; and a light source comprising a plurality of point light sources arranged in series in a longitudinal direction of the outer layer at a position facing a lowest section of the outer layer across the rim on an area facing the inner surface of the rim, the plurality of point light sources emitting light toward the rim.

2. The grand piano according to claim 1, wherein the outer layer is layered on an area tall enough to cover and hide a fixture of a frame arranged above the soundboard if viewed from an outside of the rim.

3. The grand piano according to claim 1, wherein the inner layer is layered on an area to contact the soundboard and thereunder.

4. The grand piano according to claim 1, wherein the light source is arranged at a position facing a lowest section of the inner surface of the rim.

5. The grand piano according to claim 1, wherein the light source is arranged in a mounting section, which is a hollow created in an inner rim arranged inside the rim.

6. The grand piano according to claim 1, wherein the light source is formed by applying a tape-shaped light source along the rim, the tape-shaped light source comprising a tape-shaped main body and the plurality of point light sources arranged in series in a longitudinal direction of the main body on one surface of the main body.

7. The grand piano according to claim 1, wherein the plurality of point light sources are LEDs.

* * * * *